United States Patent [19]

Arikawa et al.

[11] Patent Number: 4,920,327

[45] Date of Patent: Apr. 24, 1990

[54] CHIP-TYPE MICRO-FUSE

[75] Inventors: Hiroo Arikawa, Tokyo; Yasutada Yuza, Kanagawa, both of Japan

[73] Assignee: SOC Corporation, Tokyo, Japan

[21] Appl. No.: 251,441

[22] Filed: Sep. 30, 1988

[30] Foreign Application Priority Data

Oct. 1, 1987 [JP] Japan ..... 62-149330[U]

[51] Int. Cl.[5] ..... H01H 85/16

[52] U.S. Cl. ..... 337/231; 337/234; 337/236; 337/252

[58] Field of Search ..... 337/231, 227, 228, 234, 337/235, 236, 237, 238, 246, 248, 251, 252, 232, 253

[56] References Cited

U.S. PATENT DOCUMENTS

| | | | |
|---|---|---|---|
| 1,443,886 | 1/1923 | Sands | 337/234 |
| 3,094,600 | 6/1963 | Kozacka | 337/232 |
| B1 3,979,709 | 10/1987 | Healey, Jr. | 337/186 |
| 4,158,187 | 6/1979 | Perreault | 337/248 |
| 4,228,417 | 10/1980 | Belcher | 337/253 |
| 4,467,308 | 8/1984 | Arikawa et al. | 337/252 |
| 4,559,514 | 12/1985 | Arikawa | 337/252 |

*Primary Examiner*—H. Broome

*Attorney, Agent, or Firm*—Wenderoth, Lind & Ponack

[57] ABSTRACT

A chip-type micro-fuse including a fusible element, a hollow body made of heat-resistant and insulative materials having at lesat two recesses which are respectively formed on an outer peripheral surface thereof, near the ends thereof and two end caps adapted to respectively cover the ends of the body for electrically connecting the body with external circuits. The end portions of the fusible element are respectively connected at the recesses to the end portions of the body. Further, the recess defined near one end portion of the body is positioned diagonally spaced with respect to another recess defined near the other end of the body. Thus, the fusible element is diagonally stretched between the ends of the body across the inner space of the body. When assembled, the end portions of the fusible element are respectively drawn out from the interior of the fuse without damaging the fusible element and connected at the recesses to the body. Furthermore, the end portions of the body are respectively fitted into the corresponding end caps such that the end portions of the fusible element are firmly held between the outer peripheral surface of the body and the inner walls of the end caps, respectively. Thus, this highly reliable chip-type micro-fuse can readily be made simply by inserting the end portions of the body into the end caps by the use of a press.

10 Claims, 1 Drawing Sheet

CHIP-TYPE MICRO-FUSE

FIELD OF THE INVENTION

The present invention relates to electric fuses and more specifically to chip-type micro-fuses which are useful in, for example, electronic printed-circuit boards (PCBs) and which can be surface-mounted, that is, mounted directly on the surface of a PCB by, for example, soldering thereto.

BACKGROUND OF THE INVENTION

Sub-miniature fuses are now widely used in PCBs in various electric and electronic equipment. Recently, such equipment has been needed to be even more miniature. Thus, further miniaturization of devices for use in electric and electronic equipment has been also demanded. The devices such as capacitors have been sufficiently miniaturized while no chip-type micro-fuse which meets the demands for the further miniaturization thereof, high reliability and high productivity has been realized because of difficulty and troublesomeness in assembling parts into such a chip-type micro-fuse.

SUMMARY OF THE INVENTION

It is accordingly an object of the present invention to provide a chip-type micro-fuse which is not only of simple structure and high reliability but also allows a high output and low production cost without increasing the number of parts and which can be preferably surface-mounted.

To accomplish the aforementioned object, in accordance with an aspect of the present invention, there is provided a chip-type micro-fuse which includes a hollow body made of heat-resistant and insulative materials, a fusible element being stretched between first and second ends of the body across an inner space thereof, first and second end portions of the fusible element being respectively connected with the first and second ends of the body and a first and second terminal means adapted to respectively cover the first and second ends of the body for electrically connecting said body with external circuits, wherein: the first and second recesses are respectively formed on an outer peripheral surface of the body near the first and second ends of the body such that the first recess is positioned diagonally with the second recess; the first and second end portions of the fusible element are respectively drawn out from the interior of the fuse without damaging the fusible element and connected at the first and second recesses to the body such that the fusible element be diagonally stretched between the first and second ends of the body across the inner space of the body; and the first and second end portions of the body are respectively fitted into the first and second terminal means such that the first and second end portions of the fusible element be firmly held between the outer peripheral surface of said body and the inner walls of the first and second terminal means, respectively.

Thereby, a highly reliable chip-type micro-fuse can readily be made simply by firmly fitting the end portions of the body into the terminal means by, for example, what is called a press fit.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference numerals refer to like parts throughout the different views, and in which.

DETAILED DESCRIPTION OF THE PREFERRED EMBODIMENTS

Figure 1:
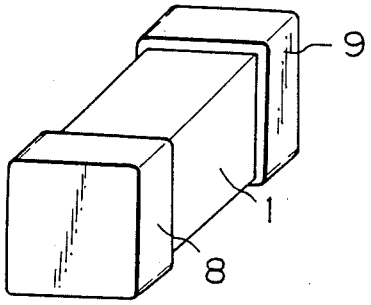
FIG. 1 is a perspective view of a finished chip-type fuse made in accordance with the present invention.

Referring first to FIG. 1, there is shown an exterior of a finished chip-type micro-fuse made in accordance with the present invention. As shown in this figure, the fuse has a prism shaped body 1 and a pair of end caps or terminals 8 and 9 attached to ends of the body 1.

Figure 2:
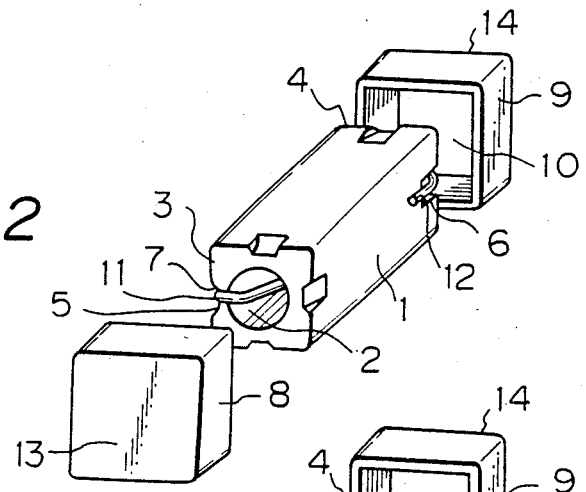
FIG. 2 is an exploded perspective view of a chip-type fuse embodying the present invention.

Next, referring to FIG. 2 which shows parts of the fuse of FIG. 1 prior to their assembling, a cylindrical space 2 is provided or bored within the interior of the body 1 made of heat-resistant and insulative materials. Further, notches or recesses 5 and 6 are formed along the outer periphery of the body 1 near both longitudinal ends 3 and 4 of the body 1.

The pair of end caps 8 and 9 are connected with both of the ends 3 and 4 to electrically connect the fuse with external circuits located on a PCB on which the fuse is to be provided, and to fix a fusible element 7 stretched across the cylindrical space 2 in the body 1.

While the ends 3 and 4 and the terminals or end caps 8 and 9 are respectively press-fitted into the body 1, the notches 5 and 6 at both ends or end faces 3 and 4 of the body 1 are intended to prevent the fusible element from being damaged when end portions 11 and 12 of the fusible element 7 tensionally stretched across the cylindrical space 2 are drawn out of the interior of the body 1 to the exterior thereof.

When the fusible element 7 is connected at both ends thereof with the end caps 8 and 9, one end 11 of the fusible element 7 may be drawn out from the recess 5 formed at the edge of the end face 3 through the cylindrical space 2, while the other end 12 of the fusible element 7 may be drawn out from another recess 6 which is formed on another end face 4 diagonally spaced with respect to the recess 5. The end portions 3 and 4 of the body 1 are respectively fitted into the end caps 8 and 9, the inner surfaces 10 of which have already been soldered, by the use of a press, while outer surfaces 13 and 14 of the end caps 8 and 9 are simultaneously heated to solder the fusible element 7 with the end portions of the element 7 being held between the end caps 8 and 9 and the end surfaces 3 and 4. The fusible element 7 can be fixed in the fuse without being subjected to any unnecessary tension by drawing each of end portions 11 and 12 of the element 7 out through a corresponding one of the recesses 5 and 6 formed on the end faces 3 and 4.

Unless the recesses are formed on the outer peripheral surface of the body 1, when the end portions of the body 1 are fitted into the end caps, the portions of the fusible element 7 held between the outer peripheral surface of the body and the surfaces of the inner walls of the caps can be outwardly drawn by frictional force created between them with the result that the fusible element can be elongated or torn off thus changing its fusing characteristics or causing its accidental fusing or melting.

In contrast, according to the present invention, when the end portions of the body 1 are fitted into the end caps, the respective end portions of the fusible element 7 are drawn outwardly through the corresponding recesses formed on the outer peripheral surfaces of the body near the ends thereof. Thereby, the chip-type micro-fuse of the present invention can obtain stable fusing characteristics without applying any undesirable force on the fusible element.

Figure 3:
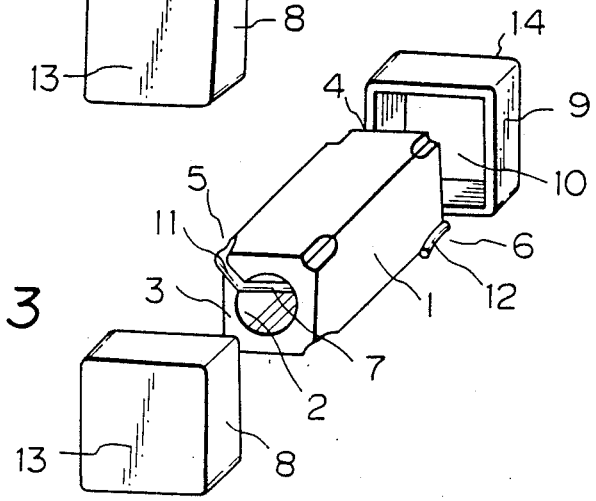
FIG. 3 is an exploded perspective view of another chip-type fuse embodying the present invention.

As can be easily seen from each of FIGS. 1–3, the end faces of end portions 3 and 4 can be four-sided or quadrangular. Likewise, the mating terminals or end caps 8 and 9 can also be four-sided or quadrangular for fitting therewith, as described above.

As described above, an aspect of the present invention resides in that a highly reliable and chip-type micro-fuse can readily be made simply by drawing the end portions of the fusible element out from the notches or recesses formed on the outer surface thereof near the ends of the body and fitting the notched end portions of the body into the end caps or terminals of the fuse with the end portions of the fusible element being firmly held between the outer surface of the body and the inner surfaces of the end caps.

Having described the present invention as related to the embodiments shown in the accompanying drawings, it is our intent that the invention be not limited by any of the details of description, unless otherwise specified, but rather or constructed broadly within its spirit and scope as set out in the appended claims.

What is claimed is:

1. A chip-type micro-fuse comprising:

a body made of heat-resistant and insulative material, said body having a pair of end faces spaced opposed to each other, an outer peripheral surface extending between said pair of end faces, a hole defined in said body and extending through said body between said pair of end faces, at least two recesses respectively provided on said outer peripheral surface at each one of said pair of end faces of said body;

an elongated fusible element, the length of said fusible element being longer than that of said hole, said fusible element being disposed within and extending through said hole in said body, one of a pair of end portions of said fusible element being disposed on one of said pair of end faces and in one of said recesses provided at one of said pair of end faces of said body, the other one of said pair of end portions of said fusible element being disposed on the other one of said pair of end faces and in the other one of said recesses provided at the other one of said pair of end faces of said body, and the remaining portion of said fusible element extending between said pair of end faces through said hole in said body; and a pair of conductive and solderable terminal members respectively fitted onto a corresponding one of said pair of end faces of said body, each one of said pair of terminal members including a wall having an inner face opposing the respective end face of said body, a peripheral portion connected angularly to the periphery of said wall and covering said outer peripheral surface at each one of said pair of end faces of said body, each one of said end portions of said fusible element disposed on each one of said pair of end faces being firmly held between each of one of said pair of end faces of said body and each one of said inner faces of said terminal members, and each one of said end portions of said fusible element being electrically connected to each one of said inner faces of said terminal members.

2. A chip-type micro-fuse as claimed in claim 1, wherein one of said two recesses provided on said outer peripheral surface at one of said end faces of said body is disposed diagonally relative to the other one of said two recesses provided on said outer peripheral surface at the other one of said end faces of said body, wherein said fusible element is stretched diagonally through said hole in said body.

3. A chip-type micro-fuse as claimed in claim 1, wherein each one of said at least two recesses has a tapered shape, and the depth of each one of said recesses increases toward the respective end face of said body.

4. A chip-type micro-fuse as claimed in claim 1, wherein the shape of said wall of said terminal member is quadrangular, and said peripheral portion of said terminal member includes four side walls extending from and substantially perpendicular to the periphery of said wall.

5. A chip-type micro-fuse as claimed in claim 1, wherein the shape of said wall of said terminal member is substantially square, and said peripheral portion of said terminal member includes four side walls extending from and substantially perpendicular to the periphery of said wall.

6. A chip-type micro-fuse comprising:

a body made of heat-resistant and insulative material, said body having a pair of quadrangular end faces spaced opposed to each other, four side faces attached to and extending between said pair of end faces, a hole defined in said body and passing through said body between said pair of end faces, at least two recesses, one of said at least two recesses being provided on one of said four side faces of said body at one of said pair of end faces of said body, and the other one of said at least two recesses being provided on another one of said four side faces of said body at the other one of said pair of end faces of said body;

an elongated fusible element having a pair of end portions, the length of said fusible element being longer than that of said hole, said fusible element being disposed in and extending through said hole in said body, one of said pair of end portions of said fusible element being disposed on one of said pair of end faces and in one of said at least two recesses provided at one of said pair of end faces of said body, the other one of said pair of end portions of said fusible element being disposed on the other one of said pair of end faces and in the other one of said at least two recesses provided at the other of said both ends of said body, and the remaining portion of said fusible element extending between said pair of end faces through said hole in said body; and a pair of conductive and solderable terminal members fitted respectively onto a corresponding one of said pair of end faces of said body, each one of said pair of terminal members including a quadrangular wall having an inner face opposing the respective end face of said body, and four side walls extending from and substantially perpendicular to the periphery of said quadrangular wall and covering said four side faces at each of one of said pair of end faces of said body, each one of said end portions of said fusible element disposed on each of said end faces being firmly held between each of one of said pair of end faces of said body and each of said inner faces of said terminal members, and each one of said end portions of said fusible element being electrically connected to each one of said inner faces of said pair of terminal members.

7. A chip-type micro-fuse as claimed in claim 6, wherein each of said at least two recesses has a tapered shape, and the depth of each one of said recesses increases toward the respective end face of said body.

8. A chip-type micro-fuse as claimed in claim 6, wherein the number of said at least two recesses is eight, four of said eight recesses are provided at one end of said body, the remaining four of said recesses are provided at the other end of said body, and each of said eight recesses is provided on a side face of said body.

9. A chip-type micro-fuse comprising:

an elongated body, said elongated body being made of heat-resistant and insulative material, said elongated body having four side faces and a longitudinal axis, any cross section of said body perpendicular to the longitudinal axis of said body being substantially square, a hole defined in said body and passing through said body between a pair of end faces of said body, recesses provided on said four side faces of said body at both ends of said body, said recesses having a tapered shape, and the depth of said recesses increasing toward said each one of said pair of end faces of said body;

an elongated fusible element having a pair of end portions, the length of said fusible element being longer than that of said hole, said fusible element being disposed in and extending through said hole in said body, one of said pair of end portions of said fusible element being disposed on one of said pair of end faces and in one of said recesses provided at said one of said pair of end faces of said body, the other one of said pair of end portions of said fusible element being disposed on the other one of said pair of end faces and in the other of said recesses provided at the other one of said pair of end faces of said body, the said one of said pair of end portions being positioned diagonally relative to the said other one of said pair of end portions and the remaining portion of said fusible element extending diagonally between said pair of end faces through said hole in said body; and a pair of conductive and solderable terminal members fitted respectively onto a corresponding one of said pair of end faces of said body, each one of said pair of terminal members including a substantially square wall having an inner face opposing the respective end face of said body, four side walls extending from and substantially perpendicular to the periphery of said wall and covering said four side faces at each one of said pair of end faces of said body, each one of said end portions of said fusible element disposed on each one of said pair of end faces being firmly held between each one of said end faces of said body and each one of said inner faces of said terminal members, and each one of said end portions being electrically connected to each of said inner faces of said terminal members.

10. A chip-type micro-fuse comprising:

an elongated body made of heat-resistant and insulative material and having a longitudinal axis, any cross section of said body perpendicular to the longitudinal axis of said body being substantially square, a hole defined in said body passing through said body between a pair of end faces of said body, and recesses formed at each of the junctions between adjacent side faces of said body at both ends of said body;

an elongated fusible element having a pair of end portions, the length of said fusible element being longer than that of said hole, said fusible element being disposed in and extending through said hole in said body, one of said pair of end portions of said fusible element being disposed on one of said pair of end faces and in one of said recesses provided at said one of said pair of end faces of said body, the other one of said pair of end portions of said fusible element being disposed on the other of said pair of end faces and in the other of said recesses provided at the other one of said pair of end faces of said body and positioned diagonally relative to said one of said recesses, the remaining portion of said fusible element extending diagonally between said pair of end faces through said hole in said body; and a pair of conductive and solderable terminal members fitted respectively onto a corresponding one of said pair of end faces of said body, each one of said terminal members including a substantially square wall having an inner face opposing each one of said end faces of said body, and four side walls extending from and substantially perpendicular to the periphery of said wall and covering said four side faces at each of said pair of end faces of said body, each one of said end portions of said fusible element disposed on each of said end faces being firmly held between each of said end faces of said body and each of said inner faces of said terminal members, and each one of said end portions of said fusible member being electrically connected to each of said inner faces of said terminal members.

* * * * *